United States Patent [19]

Harrison et al.

[11] Patent Number: 4,502,180

[45] Date of Patent: Mar. 5, 1985

[54] DOOR CONTROL DEVICE HAVING PISTON ASSEMBLY WITH SEPARATELY FORMED RACK

[75] Inventors: Stephen J. Harrison; Peter E. Brown, both of Bridgenorth, England

[73] Assignee: Jebron Limited, Bridgenorth, England

[21] Appl. No.: 444,528

[22] Filed: Nov. 26, 1982

[30] Foreign Application Priority Data

Nov. 28, 1981 [GB] United Kingdom ..... 8135981

[51] Int. Cl.[3] ..... E05F 3/10

[52] U.S. Cl. ..... 16/52; 16/58; 16/62; 16/85; 16/DIG. 9; 16/DIG. 10

[58] Field of Search ..... 16/52, 58, 65, 72, 79, 16/85, 62, 64, 69, 70, DIG. 9, DIG. 10; 92/136, 138, 143

[56] References Cited

U.S. PATENT DOCUMENTS

| | | | |
|---|---|---|---|
| 1,123,810 | 1/1915 | Shaw | 16/62 |
| 1,674,756 | 6/1928 | Wuchert | 16/62 |
| 1,770,250 | 7/1930 | Norton | 16/62 X |
| 3,426,383 | 2/1969 | Lasier et al. | 16/62 |
| 3,546,734 | 12/1970 | Pollack et al. | 16/52 |

FOREIGN PATENT DOCUMENTS

| | | |
|---|---|---|
| 2700155 | 7/1978 | Fed. Rep. of Germany . |
| 1440802 | 4/1966 | France . |
| 2279917 | 2/1976 | France . |
| 2319761 | 2/1977 | France . |
| 223261 | 11/1942 | Switzerland . |
| 1142819 | 2/1969 | United Kingdom . |
| 1414851 | 11/1975 | United Kingdom . |
| 1414852 | 11/1975 | United Kingdom . |

*Primary Examiner*—Fred A. Silverberg
*Attorney, Agent, or Firm*—Cushman, Darby & Cushman

[57] ABSTRACT

The piston assembly of a hydraulically controlled door closer has a tubular wall, plugs secured in end portions of the wall and a separate rack secured inside the tubular wall between the plugs by formations on the plugs.

5 Claims, 4 Drawing Figures

DOOR CONTROL DEVICE HAVING PISTON ASSEMBLY WITH SEPARATELY FORMED RACK

SUMMARY OF THE INVENTION

The invention relates to a door control device. The device is of the kind comprising a piston which displaces a fluid when the associated door is moved. Door control devices are used for controlling the opening and closing of doors, either limiting the speed of opening or closing or limiting the degree of opening or limiting both of these.

According to an aspect of the invention, there is provided a door control device comprising a housing, and a piston assembly which is slidable the housing, wherein the piston comprises a tubular wall portion, a pair of end plugs attached to the wall portion adjacent to respective ends thereof, and a rack disposed inside the wall portion with teeth of the rack extending transversely of and equidistant from the axis of the bore.

There is also provided according to the invention a door control device comprising a housing, a piston assembly which is slidable within the housing and which includes a rack, a pinion enmeshed with the rack and rotatable about an axis which is fixed with respect to the housing, a spindle on which the pinion is carried and an arm having an aperture in which an end portion of the spindle is received, wherein said end portion of the spindle has three axially extending grooves and the shape of the aperture in the arm is complementary to the cross-section of the end portion of the spindle.

According to the invention, there is also provided a door control device comprising a housing, a piston assembly slidable along a passage defined by the housing and a duct which extends from one end zone of that passage past an end face of the piston assembly, wherein the duct comprises one port in said end zone, a further port spaced from said end face in a direction away from the end zone and another port which is exposed in the end zone when the piston assembly is at one limit of its travel, is also exposed when the piston assembly is at an opposite limit of its travel but is obscured by the piston when the latter is in an intermediate position.

There is also provided according to the invention a door control device comprising a housing, a piston assembly slidable along a passage defined by the housing, a duct which extends from a first end zone of the passage to a second end zone of the passage and adjustable restricting means for restricting flow of fluid along the duct.

BRIEF DESCRIPTION OF THE DRAWINGS

An example of a door control device in accordance with the invention will now be described with reference to the accompanying drawings, wherein.

DETAILED DESCRIPTION

Figure 1:
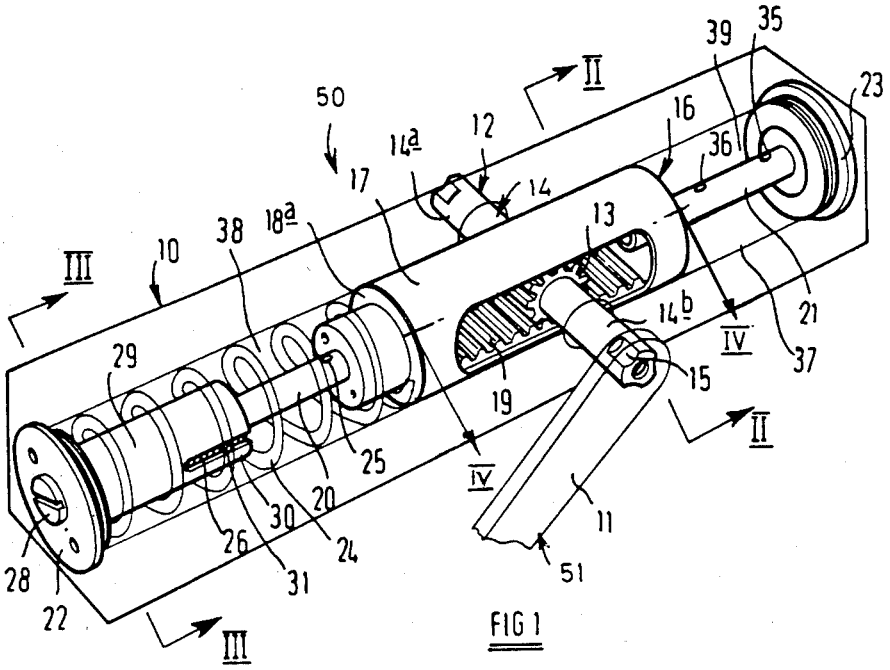
FIG. 1 is a perspective view of part of the device with parts thereof cut away.

A door control device 50 comprises a housing 10 which is mounted on a door, and an arm assembly 51. One arm of the arm assembly (not shown) is pivotally connected, adjacent one end, to a fixed structure adjacent to a door and, adjacent the other end, to another arm 11. The other arm 11 is connected at the end portion thereof shown in the drawing to a pinion assembly 12 which extends through the housing 10. The pinion assembly is mounted for rotation in the housing about an axis which is fixed with respect to the housing, and the arm assembly is arranged so that opening or closing of the door causes rotation of the pinion assembly. When the device is fitted for use, the axis of rotation of the pinion assembly is substantially vertical. The external surface of the housing defines a square cross-section and the housing is elongate. The housing defines a passage which is a cylindrical bore 37 which extends along the length of the housing.

The pinion assembly 12 comprises a pinion 13 carried on a spindle 14 which extends from either side of and is co-axial with the pinion. The spindle is seated in bushes (not shown) in opposite walls of the housing and end portions 14*a*, 14*b* of the spindle protrude beyond respective bushes from either side of the housing. The axis of rotation of the pinion assembly is transverse to the axis of the cylindrical bore 37 of the housing.

An arm can be fitted on either of the end portions 14*a* and 14*b* of the spindle of the pinion assembly 12 by means of three circumferentially spaced grooves 15 which extend axially from a respective end face of the spindle. The surfaces of the grooves are cylindrical with axes of curvature which are slightly inclined to the axis of the pinion assembly to provide a taper on which an arm with an aperture of suitable dimensions can make a tight fit. Peripheral surfaces of the spindle are substantially cylindrical, the peripheral surfaces having radii of curvature which are approximately the same as the radii of curvature of the grooves. The arm 11 is shown in engagement with the end portion 14*b*. The shape of an aperture in the arm complements the shape of the cross-section of the end portion so that the arm can be fitted in one of the three alternative orientations on the spindle.

In the bore 37 of the housing 10, there is a piston assembly 16 which comprises a tubular wall portion 17 of uniform thickness and separately formed substantially identical end plugs 18*a* and 18*b* at opposite ends of the wall portion. The piston assembly is in a sliding fit in the cylindrical bore with the axes of the tubular wall portion and of the bore substantially colinear. Parts of the outwardly facing surface of the wall portion, at least adjacent to the end plugs, engage the surface of the cylindrical bore to form a substantially fluid-tight seal. The wall portion has a pair of diametrically opposite apertures which extend over a greater part of the length of the piston assembly and through which the pinion assembly 12 extends.

Figure 2:
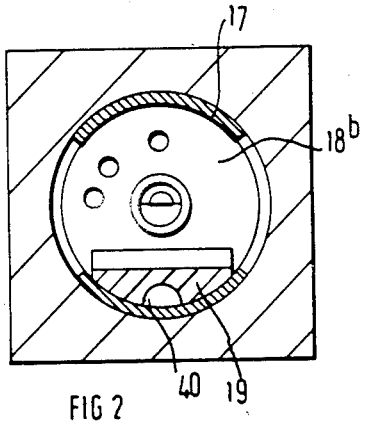
FIG. 2 is a cross-section along the lines II—II of FIG. 1.

The piston assembly 16 further comprises a rack 19 in the space defined by the wall portion 17 and end plugs 18. The rack has a part-cylindrical surface in face-to-face engagement with the inwardly facing surface of the wall portion as shown in FIG. 2, and teeth extending towards the axis of the wall portion. Opposite ends of the rack abut respective end plugs which hold the rack against movement along the length of the wall portion. Formations 40 on the end plugs project into recesses in the rack 19 to restrain movement of the rack about the axis of the wall portion. Teeth of the rack extend transversely of the axis of the cylindrical bore and are spaced the same distance from said axis. Rotation of the pinion assembly, which is enmeshed with the rack, effects movement of the piston assembly along the axis.

The wall portion 17 of the piston assembly 16 is cut from drawn tubular stock. The rack is formed by a sintering process. One of the machined plugs 18 is brazed into an end of the wall portion, and the rack is inserted into the wall portion from an opposite end thereof and brought into abutting relation with the plug with a formation 40 on the plug extending into a recess in the rack. The other plug is then brazed into the other end of the wall portion, with a formation thereof extending into a recess in the rack, so that the rack is trapped between the plugs. The rack is of a length such that opposite ends thereof abut the respective plugs. By this means the rack is restrained against movement relative to other parts of the piston assembly without being permanently attached to any part thereof. If required, the rack may be united with the wall portion or with the end plugs, for example by brazing.

Figure 4:
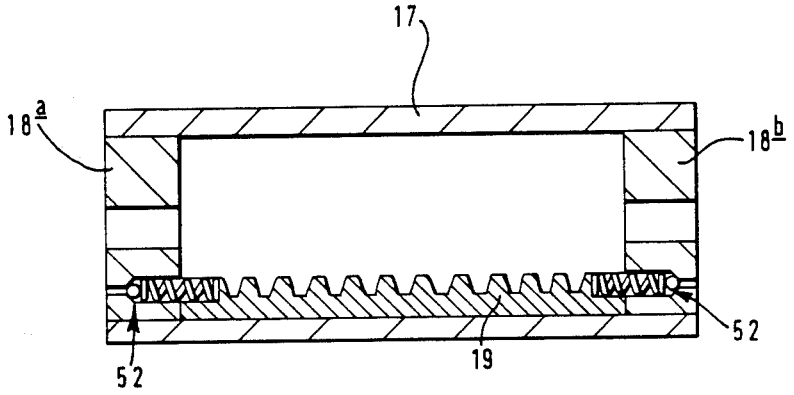
FIG. 4 is a cross-section on the lines IV—IV of FIG. 1.

Pressure relief valves 52 in each of the end plugs provide one means for fluid to pass from one side of the piston assembly to the other when the assembly is sliding in the bore at least in one direction. FIG. 4 shows a pressure relief valve, which is a ball valve, adjacent to each end of the rack. A ball is retained in an aperture of stepped diameter in each plug by means of a spring which extends between the ball and the innermost part of a recess in the rack. The ball valves provide a pressure relief means to prevent damage occuring to parts of the door control device due to excessive pressure. Each end plug comprises at least two pressure relief valves which act in opposite directions.

A rod 20 of the device protrudes in a direction away from an end cap 22 of the housing 10, through end plug 18*a* into the space defined by the piston assembly. A rod 21 protrudes in the opposite direction, that is away from an end cap 23, through end plug 18*b* into the space defined by the piston assembly. The end caps provide fluid tight seals at opposite ends of the bore 37. The rods are in sliding substantially fluid tight engagement with the end portions 18 of the piston assembly, and axes of the rods coincide with the axis of the cylindrical bore and of the piston assembly. A stressed spring 24 extends from end cap 22 to end plug 18*a*, about rod 20, which spring provides a biasing force on the piston assembly in a direction away from end cap 22. The rods define ducts for the passage of fluid between end zones 38 and 39 of the bore 37, which end zones extend between the piston assembly and, respectively, end cap 22 and end cap 23.

The end of rod 20 which lies in the space defined by the piston assembly 16 is open to the passage of fluid into and out of the duct. A first port comprises an aperture 25 in the rod through which fluid which enters the duct at the open end can pass into the end zone 38 of the bore 37 and through which fluid can enter the duct from the end zone 38 to flow to the open end of the duct. The end portion of rod 20 which lies in the end zone 38 is adjacent to end cap 22 and supported by means of a pair of sleeves 27 and 29.

The position of the aperture 25 can be adjusted along the length of the bore 37. An external thread 26 on the rod 20, which is adjacent to the end cap 22, co-operates with an internal thread of a first sleeve 27. An end of the sleeve 27 is in rotational sliding engagement with the end cap 22 and a head 28 of the sleeve protrudes through the end cap to provide a means for rotating the sleeve. A second sleeve 29 surrounding the first sleeve is in a fixed engagement with the end cap. A pair of diametrically opposite slots 30 (one of the slots is shown in FIG. 1) extend axially from an opposite end of the second sleeve from that which is connected to the end cap. Pins 31 extend radially from the rod into the slots to prevent relative rotation of the rod and the second sleeve. Rotation of the first sleeve effects movement of the rod 20 in an axial direction by means of the threaded engagement with the rod so that the position of the aperture 25 can be adjusted.

Figure 3:
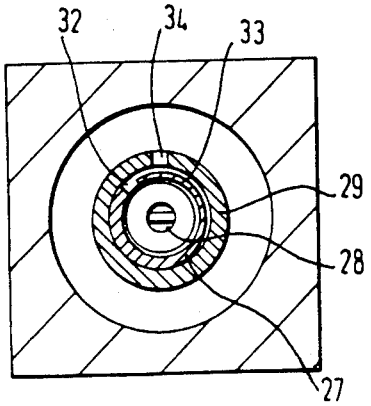
FIG. 3 is a cross-section along the lines III—III of FIG. 1.

A second port for the passage of fluid into and out of the duct defined by the rod 20 comprises a first aperture 32 in the first sleeve adjacent to an open end of the rod which in turn is adjacent to end cap 22. A groove 33 of the second port extends from the aperture 32 circumferentially on the outer surface of the first sleeve. As shown in FIG. 3, the depth of the groove decreases in a direction along the groove away from the aperture. The second port further comprises a second aperture 34 in the second sleeve. The first aperture, groove and second aperture provide a restricted flow path for fluid adjacent to the end of rod 20. The head 28 and the parts defining the second port form an adjustable restricting means. The degree of restriction is adjusted by rotation of the head of the first sleeve, by which means the length of the groove along which fluid must pass during passage between the apertures is varied. The decrease in depth along the length of the groove provides for a sensitive adjustment of the degree of restriction. It will be apparent that the degree of restriction can be adjusted by rotation of the first sleeve to a position where there is no passage between the apertures.

Rod 21 comprises a third port which is an aperture 35 adjacent to end cap 23, in end zone 39 of the bore 37, and a fourth port which is an aperture 36 part-way between aperture 35 and the open end of the rod which lies in the space defined by the piston assembly. A restricting means lies in the rod between the aperture 36 and the free open end of the rod.

The degree of restriction of the restricting means can be adjusted by means of a head, not shown in the drawing, which protrudes through the end cap 23. The head is at one end of a spindle which extends along the length of the duct defined by the rod and is in a substantially fluid-tight rotationally sliding engagement in the end cap 23. Rotation of the head effects rotation of the spindle. A member in the rod is in threaded engagement with the internal surface of the rod between the aperture 36 and the free end of the rod. The spindle engages the member and rotation of the spindle effects axial displacement of the member towards or away from a surface which tapers with respect to the direction of movement of the member. The member can be adjusted to a position where the aperture 36 is closed.

The operation of the door control device assembly will now be described. When the associated door is being opened, pivoting of the arm assembly causes rotation of the pinion assembly which in turn produces a longitudinal movement of the piston assembly against the action of the spring 24. A fluid in the housing, such as oil, is forced to flow through the end plugs of the piston assembly along ducts defined by the rods 20 and 21.

In passing from one side of the piston assembly to the other, fluid enters rod 20 through aperture 25, leaves the rod from the free end thereof, enters rod 21 through the free end thereof and leaves rod 21 by aperture 35 or 36. A door stop effect is provided when the piston assembly has passed sufficiently far along the cylindrical bore of the housing to close the aperture 25. Fluid can then only enter rod 20 through the constricted passage of the second port at the end of the rod, so that opening of the door is necessarily a slower operation.

A means for adjusting the degree of restriction of the second port, and hence the speed at which the door may be opened when aperture 25 is obscured, has been described.

The spring 24 can effect closure of the door. The piston assembly moves towards end cap 23 and fluid in the housing flows in the reverse direction to that described for opening of the door.

The dimensions of the ducts in the rods controls the rate of flow of fluid and thereby the rate of closure of the door. Aperture 36 in rod 21 provides a means for an increase in the rate of closure of the door as the door approaches the frame so that the door can develop sufficient momentum to overcome a latch. Aperture 36 is exposed on either side of end plug **18*b* for different positions of the piston assembly and is also obscured by the end plug when the piston assembly is in an intermediate position. When the door is nearly closed, aperture 36 is on the opposite side to end plug 18*b* of the piston assembly to aperture 35. Fluid can then pass across the end plug by a passage between the apertures which is relatively less constricted than is the passage between the free end of the rod 21 and aperture 36**.

We claim:

1. A door control device comprising a housing, defining an axis and a piston assembly which is slidable in the housing along the axis, wherein the piston assembly comprises a tubular wall portion having opposite ends, a pair of separate end plugs received in and attached to the wall portion adjacent to respective ones of said ends thereof, and a rack formed separately from the tubular wall portion and the plugs and disposed inside the wall portion with teeth of the rack extending transversely of and equidistant from said axis, wherein opposite ends of the rack abut respective said end plugs, wherein one of the end plugs has formations which engage the rack and wherein said formations overlap with the rack along said axis to restrain movement of the rack about said axis, a pressure relief valve comprising a spring acting and secured between the rack and the valve, wherein the valve is located adjacent the abutment of the rack and the end plug.

2. A door control device in accordance with claim 1 wherein the tubular wall portion comprises diametrically opposite apertures.

3. A door control device according to claim 1 including a pinion assembly which comprises a pinion which is enmeshed with the rack and rotatable about an axis which is fixed with respect to the housing, and a spindle on which the pinion is carried, the device further including an arm having an aperture in which an end portion of the spindle is received, wherein said end portion of the spindle has three axially extending grooves and a shape of the aperture in the arm is complementary to the cross-section of a end portion of the spindle.

4. A door control device in accordance with claim 1 comprising a duct which extends from a first end zone in the housing to a second end zone in the housing and an adjustable restricting means for restricting flow of fluid along the duct wherein the restricting means comprises relatively adjustable first and second elements which collectively define a restricted flowpath for said flow of fluid, the length of which path can be varied by relative adjustment of the first and second elements.

5. A door control device in accordance with claim 4 wherein said first and second elements collectively define for said restricted flowpath a cross-sectional area transverse to the length of the path which decreases in a direction along the path.

* * * * *